United States Patent [19]

Good

[11] Patent Number: 4,609,109

[45] Date of Patent: Sep. 2, 1986

[54] SUPERCONDUCTING MAGNETIC SEPARATORS

[75] Inventor: Jeremy A. Good, London, England

[73] Assignee: Cryogenic Consultants Limited, London, England

[21] Appl. No.: 777,623

[22] Filed: Sep. 19, 1985

Related U.S. Application Data

[63] Continuation-in-part of Ser. No. 395,224, Jul. 6, 1982, abandoned.

[51] Int. Cl.[4] ..... B07C 5/344

[52] U.S. Cl. ..... 209/636; 209/638; 209/213; 209/223 R; 335/306

[58] Field of Search ..... 209/212, 636, 638, 223 R, 209/223 A, 231, 213; 335/216, 306, 309

[56] References Cited

U.S. PATENT DOCUMENTS

| | | | |
|---|---|---|---|
| 377,518 | 2/1888 | Edison | 209/636 X |
| 3,187,237 | 6/1965 | Craig et al. | 335/306 X |
| 3,889,220 | 6/1975 | Spodig | 335/306 |
| 4,031,004 | 6/1977 | Sommer, Jr. et al. | 209/636 X |
| 4,209,657 | 6/1980 | Inai et al. | 335/216 |
| 4,277,768 | 7/1981 | Burgeson et al. | 335/216 |
| 4,277,769 | 7/1981 | Hieronymus | 335/216 |

FOREIGN PATENT DOCUMENTS

| | | | |
|---|---|---|---|
| 305102 | 12/1929 | United Kingdom | 209/212 |
| 2064377 | 10/1980 | United Kingdom | 209/223 A |
| 776639 | 11/1980 | U.S.S.R. | 209/636 |

*Primary Examiner*—Robert B. Reeves
*Assistant Examiner*—Glenn B. Foster
*Attorney, Agent, or Firm*—Wood, Herron & Evans

[57] ABSTRACT

A superconducting magnetic separator wherein the magnet coil or coils are in the shape of a vertically oriented oval. The coils are mounted in an evacuated cryostat housing which provides a flat vertical magnetic separating zone on one or both vertical faces.

6 Claims, 4 Drawing Figures

SUPERCONDUCTING MAGNETIC SEPARATORS

Figure 1:
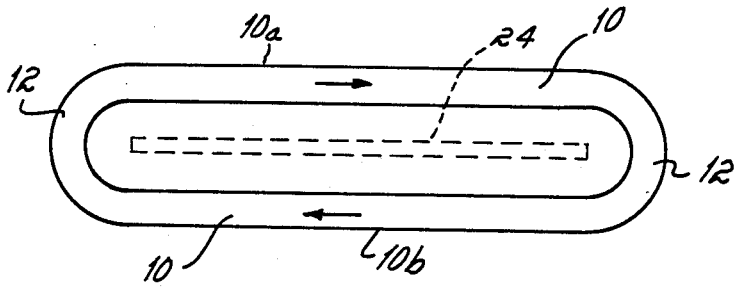

This application is a continuation-in-part of application Ser. No. 395,224, filed July 6, 1982, to be abandoned.

This invention relates to magnetic systems for use in separating particulate mixtures of magnetically responsive and non-responsive fractions, and especially to methods of minerals separation.

The invention is generally concerned with a separation system in which the material to be separated falls past a cryogenic superconducting magnet. The relatively magnetic material is attracted towards the magnet and the non-magnetic material continues in a relatively straight path. A splitter member separates the two streams.

More particularly, the invention relates to the design and housing of a linear superconducting coil to be used as the separating magnet.

The problems of adequate magnetic strength and cost of operation must be overcome simultaneously in order to separate a magnetically responsive fraction in a mineral ore effectively and economically. The superconducting coil needed to generate a high magnetic field must be refrigerated to a very low temperature, roughly 40 Kelvin or close to that. The operating cost (power requirements) of refrigeration is the principal operating cost of the separator in such a system, and the cost of the magnet and the associated refrigerating mechanism is the principal capital cost of the separator. Refrigeration power required, that is, the continuous load on the refrigerator, is dependent on magnet surface area and on the quality of the insulation. The thermal mass and specific heat of the chilled parts of the cryo-magnet determine the peak refrigeration power required to cool the magnet to its operating temperature in a reasonable time. In practice, the mass of the cryo-magnet largely determines both the operating cost and the capital cost of the refrigerator. Therefore, in order to achieve economic performance, it is important to have as large a separating capacity as possible for a given mass of superconducting magnet.

Previous magnetic separators (see U.K. patent application of Cohen and myself, U.S. Pat. No. 2,064,377, filed Oct. 2, 1985) have employed a pair of circular horizontally oriented superconducting magnetic coils to provide a strong magnetic field and a high field gradient in the separation zone around the coils. This necessitated use of annular separation channels around the circular coils. If the channels are of complex form, as is often the case for minerals separation, the requirement to make them annular increases the complexity and expense of the system.

In the circular geometry separator disclosed in the above-identified British patent application, two opposing coils are horizontally mounted horizontally on a non-magnetic core or former which restrains the coils against the strong magnetic repelling force acting on them. The coils are enclosed in an evacuated housing referred to as a cryostat. The coils are at about 4° K., and the outer wall of the cryostat is at ambient temperature, e.g., 300° K. or more. One problem with that circular geometry is that the coil contracts as it is cooled from ambient temperature to 4° K., and as it does so it moves radially away from the circular outer wall of the cryostat. In a large unit of say more than one meter in diameter, this increase in the gap between the coil and the housing wall substantially reduces the field strength outside the wall.

A second problem inherent in a circular geometry is that it is difficult to provide for adjustability of the deflector or splitter in a circular geometry: the splitter must move in a radial direction, toward and away from the magnets. In a circular device this requires a change in the circumferential length of the splitter.

A third difficulty with the prior art circular geometry is that it is exceedingly difficult to use both sides of the winding, i.e., the inside and the outside as separating surfaces. The core or former usually blocks the center. If a hollow or open center cryostat were built so that separation could be carried out on both an internal and an external radial surface, i.e., through the center of the winding, separator design encounters major problems. In order to provide adequate strength, the former must have a substantial radial thickness. If a large former is placed internally of the coils, then the field on the inside surface of the cryostat is much reduced, due to the space occupied by the former. If, on the other hand, the former is placed on the outside, then the field in the external separation zone is similarly reduced.

According to the present invention, the foregoing problems of circular design are overcome by using magnets which are in the shape of ovals oriented vertically, in a cryostat housing which provides a flat vertical magnetic separation zone on one or both sides. The coils can provide an effective separating force over a much larger volume, that is, capacity is large in comparison to horizontal circular coils of comparable volume.

Preferably two vertical coils are provided, aligned back to back, each coil being oval or rectangular as seen in elevation, and each having one long edge above the other long edge of the same coil so that its long axis is horizontal and its ends vertical. The coils are enclosed in a "slab-like" cryostat housing which is generally rectangular in plan, and which is also rectangular in cross section. With such a dipole magnet of high field strength, good depth of field is achieved, and the separation zone adjacent the large vertical outer wall(s) of the cryostat is rectangular and flat. Thus, there can be two separating zones, one on each side of the slab-like cryostat.

In the evacuated space between the coils and the wall, insulation is fitted to intercept the radient and conducted heat which otherwise would flow from the wall of the cryostat to the cooling means. Since the separation process takes place on the outside of the cryostat, and since the magnetic field and force decrease rapidly with distance from the windings, it is important that the outer wall of the cryostat be as close to the magnet coils as possible, and that the thermal insulation be as thin as possible. External air pressure acting on the flat wall of the cryostat tends to deflect the wall inwardly, toward the evacuated magnet chamber. I have found that such movement can press the insulation against the coils and greatly reduce its effectiveness, thus greatly increasing the power requirements for the coils. In order to overcome this flexion, internal means are provided to resist such wall movement. However, the repelling forces between adjacent coils must be opposed by a rigid internal restraining means. I have found it important to make provision that the supports for the walls not bear against or even contact the coil confining member, in order to minimize heat transfer from the walls into the middle of the cryostat.

A straight separation channel can thus be presented at each large face of the slablike cryostat. The use of a straight (flat) channel enables the position of the splitter plates within the channels much more easily to be adjusted linearly toward and away from the housing, as compared with the radial adjustment required for curved or annular plates.

More than one pair of coils may be used, one pair positioned above another pair in the housing. If required, several pairs of coils in separate cryostats or a single cryostat, can be cascaded one above the other. The coils may be energized in either the same direction or reverse directions, so as to vary the field modulus and gradient in the separation zone.

Advantages of this invention also include reduced load on the supercooling arrangement, more efficient generation of magnetic field for a given mass of superconductors, and use of both sides of the coil. Moreover, in a linear magnet thermal contraction of the coils moves the coils linearly away from the outside of the cryostat, rather than radially as in a circular geometry.

To separate the minerals or other magnetically responsive mixtures, a feed channel is used which may be of the cascade type or free fall type, preferably as described below.

For example a mineral of susceptibility $10^{-5}$ cgs units per unit mass in a field times gradient product of $50\times10^{6}$ gauss$^2$ cm$^{-1}$, the force due to the magnetic field is half that of gravity. If the ore is fed as a stream down the vertical wall, the magnetic force will pull magnetic mineral toward the wall. Friction against the wall reduces the falling velocity and ore separation takes place. It is a preferred feature of the invention that the wall should be so configured as to cause the magnetic material to be retained against or adjacent the wall, and to cause the non-magnetic fraction to be diverted outwardly away from the magnet and the wall. In an advantageous configuration the wall is arranged to have at least one, and if space permits, several, humps or ridges to give the non-magnetic particles momentum away from the wall. The non-magnetic material is thereby diverted away while the magnetic particles follow the surface of the wall. The relatively non-magnetic fraction is collected by a splitter set below each ridge and is thereby separated from the remaining magnetically responsive fractions.

Figure 2:
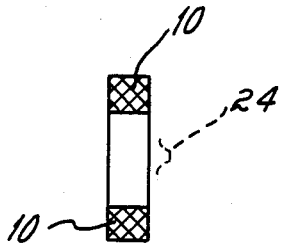
Figure 3:
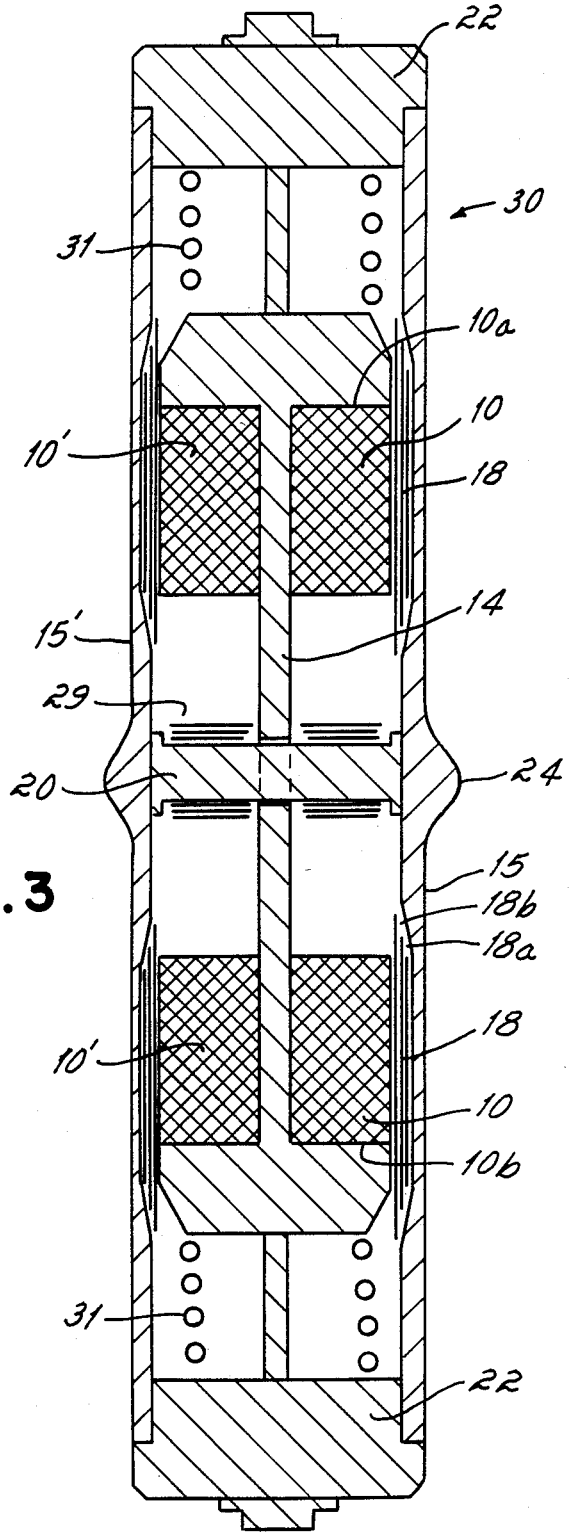
Figure 4:
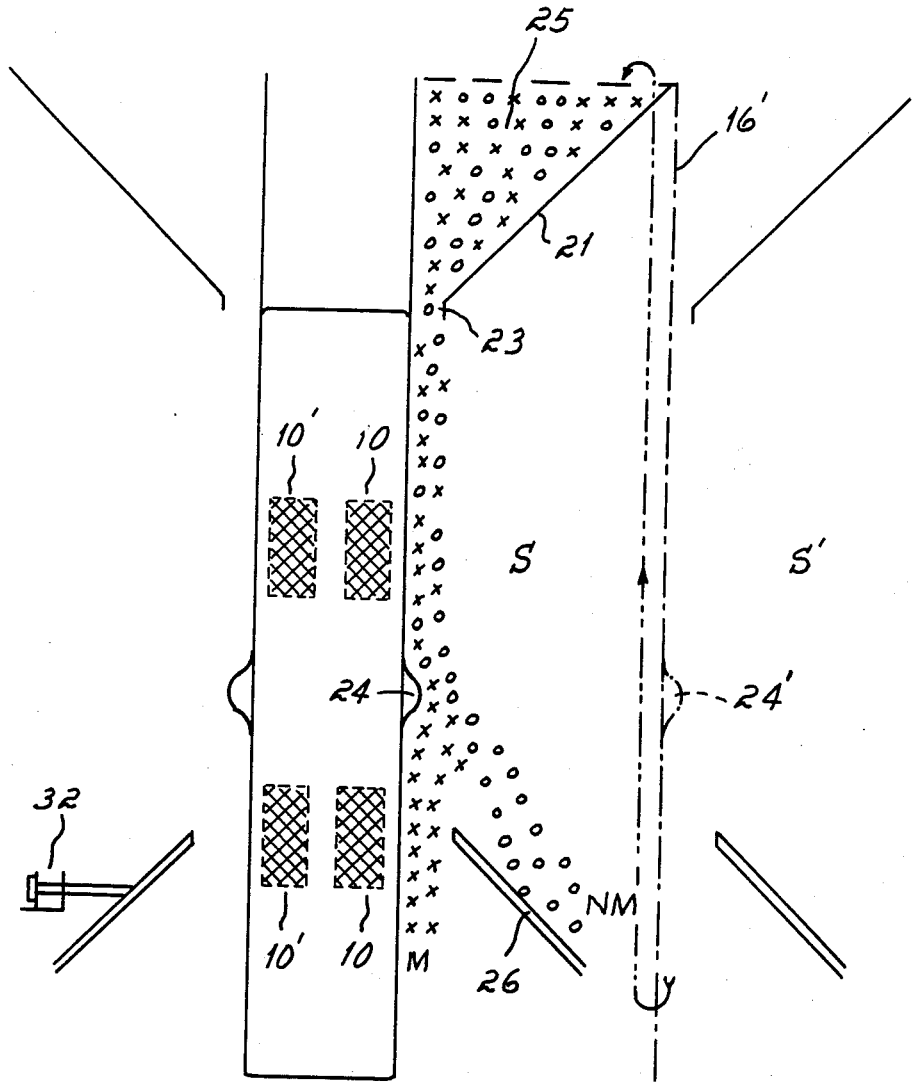

The invention will now be further described by way of example with reference to the accompanying drawings in which:

FIG. 1 is a diagrammatic front elevation of an oval (linear) magnet coil illustrating the shape thereof, FIG. 2 is a diagrammatic vertical cross-section of the coil of FIG. 1, FIG. 3 is a more detailed cross-section of a pair of coils, and FIG. 4 is a diagrammatic view of a portion of a magnetic separator in accordance with the invention.

Referring to the drawings, each linear cryogenic magnet coil 10 in the form of an oval or rounded rectangle having horizontal, approximately straight parallel upper and low winding edges or portions 10*a*, 10*b*, with ends 12 of approximately semi-circular shape (FIG. 1).

In use two linear coils 10, 10′ such as are shown in FIGS. 1 and 2 are placed back to back with their long sides 10*a*, 10*b*, horizontal and their ends 12 vertical as can be seen in FIG. 3. To sustain the repelling forces between the straight portions 10*a*, 10*b*, a coil-confining member or yoke 14 of glass fibre reinforced material or non-magnetic metal is provided. The member 14 extends from below the lower coil portion 10*b*, to above the upper portion 10*a*, and has restraining arms which project outwardly to hold these portions against vertical displacement under the electromagnetic repulsive force generated in operation. The yoke is placed between the two identical coil windings, instead of surrounding a single coil, so as not to reduce the external field at each flat surface or outer wall 15, 15′ of the cryostat.

Several sheets of super insulation 18*a* and one or more radiation screens 18*b* are provided between the coils and the outer walls of the cryostat. The walls 15, 15′ are held spaced apart by one or more transverse support members 20. These members 20 pass the yoke 14 without touching it, and are insulated as at 27 from the cold chamber 29 inside the housing 30. The yoke 14 is supercooled along with the coils, whereas the members 20 engage the side walls which are not cooled on the outside. The members 20 pass through openings in the yoke, so as to minimize heat transfer. The top and bottom of the cryostat is closed by caps 22. The magnet is provided with a refrigeration system so that the coils are super-cooled and are super-conducting in operation. Cooling tubes 31 are preferably positioned above the upper coil portion 10*a* in the housing.

In a presently preferred embodiment the cryostat housing is three meters long, 450 mm high, and 85 mm deep (thick). Two windings are each 60 mm high by 29 mm thick, and separated by 10 mm, through—which space the yoke 14 extends. There is a space of only 8½ mm between each coil and the adjacent cryostat wall, in which the superinsulation and radiation shield 18*a* and *b* are contained. The purpose of the superinsulation 18*a* is to substantially reflect the radient heat from the wall; the two intermediate temperature shields 18*b*, 18*b* intercept temperatures of about 20° and 70° K., respectively. These shields are cooled by the refrigerator coils 31. The vertical space between the upper and lower sections is 50 mm, each coil having approximately 700 turns. The vacuum which is necessary to thermally insulate the magnet is at least $10^{-6}$ torr. The force on the restraining member 14 which retains the winding is about 90 tons per meter length of the dipole. The yoke is fabricated from non-magnetic high tensile strength stainless steel. The flat sides of the cryostat are approximately 3 mm thick and tend to flex or collapse inwardly under the external air pressure when the cryostat is evacuated. The bracing means 20 will however prevent them from flexing inwardly sufficiently to press the insulation against the coils and thereby reducing its insulating effect.

In this example, approximately ten support members 20 pass through the centers of the coils and the restraining member 14, from one sidewall of the cryostat to the other. (While vertical ribs might be provided on the outside face of the cryostat to support the flat sides, these would have to extend into the separation zone and in effect would divide the zone into several separation channels, with separators having to fit between the ribs.)

The refrigerator is preferably a three-stage unit which extracts about 60 watts at 70° K., about 18 watts at about 20° K., and about 1 watt at 4° K. To distribute the cooling power along the length of the dipole, cold helium gas is circulated through the tubing 31 along the length of the radiation shields and the magnet.

The magnets illustrated in FIG. 3 may be employed in a magnetic separator as shown generally in FIG. 4 which is only of the right hand side. The left hand side is similar.

The field from such a linear dipole magnet extends out on either side, and a separation channel S can be placed on each side of the magnet member. The material to be separated is fed from a hopper 21 through an adjustable choke 23 feed to fall adjacent the wall surface 15 of the magnet in a stream about 10 mm thick. The magnetic force is adjusted, depending on the ore or other material to be separated so that the particles 25 fall down the side of the magnet under the influence of gravity, the magnetic particles being drawn towards the magnet and held against the wall. This tends to reduce the falling velocity. A smooth bump 24 (or its equivalent) is provided on the wall 16 which causes the particles falling against or adjacent the wall and especially the non-magnetic fraction, to be diverted horizontally away from the wall.

Substantially non-magnetic particles are diverted away from the magnetic particles, which tend to be re-attracted by the magnet back towards the wall surface 15.

Several bumps may be provided below each other. The concept of using such bumps forms the subject of co-pending application Ser. No. 395,225, filed July 6, 1982.

As the relatively magnetic material M falls adjacent the magnet and bump deflects the relatively non-magnetic material NM away from the magnet, the two streams are separated by an adjustable flat splitter member 26, whose position can readily be adjusted towards or away from the wall surface 15, by adjusting means 32. Typically, the stream of ore is 3 to 6 mm in thickness and the ridge or bump 24 projects 4–10 mms from the wall surface 15. It is desirable that the shape is smooth on the upper side so as to avoid remixing of the mineral. A sharp step causes mineral to be bounced at random and should be avoided as it might cause a degradation in the quality of separation. The materials are reseparated at each successive ridge or bump.

The feed channel can, if desired, be divided into a horizontal outwardly extending series of thin vertical channels, each receiving a stream to be separated, instead of one broad channel, given that the magnetic field is of sufficient extent to encompass all the channels.

For example if a second channel is used on both sides, this will be positioned outwardly of the channel S as shown on one side at S' in FIG. 4, where the magnetic field is weaker. Channel S is bounded on the magnet side by a wall 16' provided with a ridge or bump 24' similar to that shown at 24. A first pass of the material may be made through this second channel S' and then a final or second pass through the first channel S adjacent the magnet where the field is stronger.

As an example of the separation achieved tests were made using a smaller magnet than just described, on phosphate mineral containing about 14% apatite mineral and analyzing as 5.8% $P_2O_5$. In a separation at a modest magnetic field of 24,000 gauss at a flow rate of 9 ton/hour per meter of magnet length, ore was passed over two bumps of 10 mm projection from the magnet face. The ore had a free fall of 100 mm from the linear hopper during which fall it was held against the face of the channel adjacent to the magnet by the magnetic field. Below each bump the ore was split into magnetic and non-magnetic fractions. The magnetics from the first bump were then passed over the second or lower bump; the two non-magnetic fractions were combined for retreatment at a higher field. The splitter below each bump was positioned 30 mm away from the magnet face and 70 mm below the center of the bump. The non-magnetic product was 36% of the mass. The magnetic product was discarded as waste mineral. The recovery of apatite was 77% in the non-magnetic product. This product was then retreated at a higher field of 31,000 gauss.

Again the mineral was passed over the bumps of 10 mm projection after a 100 mm free fall. The splitter was set at 20 mm from the magnet wall and 70 mm below the bump. The non-magnetic product from the first bump analyzed at 38.3% $P_2O_5$ or 90.3% phosphate. Magnetic measurement of the susceptibility indicated 93% phosphate. The non-magnetic product from the second bump represented 32.4% $P_2O_5$ or 76% apatite. The recovery of this second double stage of separation was 78%. The final product was of sufficient commercial grade.

What I claim is:

1. In a magnetic separator of the type having at least one superconducting magnet coil in an evacuated cryostat housing which presents a generally vertical outer wall, means for feeding a stream containing magnetically responsive and non-responsive particles adjacent said wall, the magnetically responsive particles of said stream being drawn closer to the wall by magnetic action of said coil than the non-responsive particles, and a splitter for separating a fraction of said stream which is closer to said wall from a fraction farther from said wall, the improvement wherein, said each coil is in a generally vertical plane and has approximately straight horizontal upper and lower portions which are joined by ends, said outer wall is generally parallel to and closely adjacent said coil and tends to flex inwardly between said upper and lower portions when said housing is evacuated, insulation is provided between said coil and said outer wall, a vertical coil-confining member extends within the housing from below the lower portion to above the upper portion of the coil to hold said portions against vertical displacement by electromagnetic repulsion force acting on them in operation, transverse support means within the housing and engaging said wall between the upper and lower coil portions and holding said wall away from the coil when the housing is evacuated, so that said wall does not press said insulation against the coil, said transverse support means and coil-confining member passing one another within said housing without touching so that said transverse support means does not conduct heat from the wall to said coil-confining member.

2. The improvement of claim 1 further wherein said housing is in the form of a flat slab and has such vertical walls on two opposite sides thereof.

3. The improvement of claim 2, further wherein said separator includes at least two such coils in back to back relation in said housing, and said coil-confining member extends vertically between the coils and includes restraining arms projecting above the upper portions of the coils and arms below the lower portions thereof.

4. The improvement of claim 1 further wherein one of said transverse support means and said coil-confining member extends through an opening formed in the other thereof, so that they do not contact.

5. The improvement of claim 1 further wherein said insulation comprises thin sheet superinsulation and at least one temperature shield between the coil and the wall, said transverse support means maintaining a gap between said wall and said insulation sufficient that the wall does not press against the insulation when the housing is evacuated and the wall is deflected toward the coil.

6. The improvement of claim 1 further wherein said splitter is a flat angulated plate parallel to said wall, and means are provided for moving said splitter linearly toward and away from said wall to vary the width of a slot therebetween.

* * * * *